US008020910B2

(12) United States Patent
Startzell

(10) Patent No.: US 8,020,910 B2
(45) Date of Patent: Sep. 20, 2011

(54) SHOPPING BAG HANDLE

(76) Inventor: Jerry Startzell, Port Angeles, WA (US)

( * ) Notice: Subject to any disclaimer, the term of this patent is extended or adjusted under 35 U.S.C. 154(b) by 45 days.

(21) Appl. No.: 12/456,958

(22) Filed: Jun. 25, 2009

(65) Prior Publication Data

US 2011/0018294 A1 Jan. 27, 2011

Related U.S. Application Data

(63) Continuation-in-part of application No. 11/811,540, filed on Jun. 11, 2007, now abandoned.

(60) Provisional application No. 60/931,075, filed on May 21, 2007.

(51) Int. Cl.
*B65D 33/06* (2006.01)
*A45F 5/10* (2006.01)

(52) U.S. Cl. ..... 294/170; 294/159; 16/430

(58) Field of Classification Search ..... 294/137, 294/158, 159, 170; D9/434, 455; 16/425, 16/430, 436; 482/108
See application file for complete search history.

(56) References Cited

U.S. PATENT DOCUMENTS

| | | | | | |
|---|---|---|---|---|---|
| 391,896 | A | * | 10/1888 | Hill | 294/171 |
| 466,276 | A | | 12/1891 | Le Garde | |
| 675,314 | A | * | 5/1901 | Abenheim | 482/108 |
| 779,691 | A | * | 1/1905 | Comstock | 294/170 |
| 1,512,053 | A | * | 10/1924 | Ridlinghafer | 383/13 |
| 2,637,240 | A | * | 5/1953 | McClellan | 411/548 |
| D252,741 | S | * | 8/1979 | Taylor | D9/434 |
| 4,841,596 | A | * | 6/1989 | Fink | 16/411 |
| 5,368,393 | A | | 11/1994 | Norman | |
| 5,516,175 | A | | 5/1996 | Christiansen | |
| 5,601,327 | A | * | 2/1997 | Cho | 294/171 |
| D403,229 | S | * | 12/1998 | Chou | D8/316 |
| D404,645 | S | * | 1/1999 | Ball | D9/434 |
| 6,098,933 | A | * | 8/2000 | Stein | 248/99 |
| 6,499,781 | B1 | | 12/2002 | Flynn | |
| 6,651,941 | B1 | | 11/2003 | Kinsel | |
| D528,414 | S | * | 9/2006 | Palmer | D9/434 |
| 7,458,921 | B2 | * | 12/2008 | Hallar | 482/106 |

* cited by examiner

*Primary Examiner* — Dean Kramer

(57) ABSTRACT

An handle for carrying grocery bags and the like comprising a rod round cross section with a central portion adapted to be gripped by a human hand. On either side of the gripping portion are knobs with deep annular slots adapted to receive the handles of a grocery bag. Each bag loop handle is secured by one of the slots. The handle is attached to the bag transversely to the bag opening. The handle supports the bag in a balanced configuration without a tendency to rotate in the hand. Alternatively, one or more bags may be mounted in each slot and carried by the handle between them.

12 Claims, 2 Drawing Sheets

SHOPPING BAG HANDLE

RELATED APPLICATIONS

The present application is a continuation-in-part of application Ser. No. 11/811,540, and claims benefit of its filing date, Jun. 11, 2007 now abandoned, application Ser. No. 11/811,540 claims the filing date of Provisional Application No. 60,931,075 titled Shopping Bag Handle, filed on May 21, 2007 by the present inventor. The identified Regular application and provisional application are hereby incorporated herein by reference.

U.S. GOVERNMENT INTEREST IN THE INVENTION

None

BACKGROUND OF THE INVENTION

1. Field of the Invention

Handle means for carrying one or more bags having loop handles. In particular, a handle comprising a rod with knobs having annular grooves at each end for receiving grocery bag loop handles.

2. Description of Related Art

Grocery bag handles are members of a very crowded art. Many varieties are to be found in the US patent collection going back to 1948, long before the introduction of the modern thin plastic bag. Those closest to the present invention in that they may hold a bag crossways, or hold two or more bags on each end, have a pair of hooks flanking a central gripping portion, but the present invention does not use hooks. U.S. Pat. Nos. 6,651,941 and 6,499,781 by David Kinsel and Norman Flynn, respectively, are representative of this type of bag holder.

U.S. Pat. No. 5,368,393, FIG. 1 by J. B. Norman appears to have superficial resemblance to the present invention, but upon inspection, it is found that it too, is merely a hooks-on-the-end type, only that the hooks are fabricated integrally with the handle bar instead of being separate and attached to the tip ends of the bar.

Many other types of handles having a groove or similar along the length of the handle were found. The bag handles are laid in a longitudinal groove and the handle gripping portion passes under the bag handles. The grip orientation is similar to gripping the bag without an aid. Unless this type is carefully designed to have the handle load close to the hand contacting surface, the handle will have a tendency to rotate axially and drop the bag off the handle. The present invention cannot drop the bag handle even if the handle is rolled axially. This type of handle cannot hold a bag crossways, that is, one bag loop handle on each end of the handle bar.

Many other patents are of the wrap around type in which a sheet of material is wrapped around the handles to provide a larger surface to support the weight of a filled bag against the hand. These are mechanically similar to the longitudinally grooved handle just described, and have most of the same limitations.

Both of these embodiments hold the handle loops in the plane of the loops.

The present invention is a dumb bell configuration with an annular slot on each end adapted to receive a bag handle. The slot having a bulge at the interior end to allow the bunched bag handle to expand and be gripped by the handle so the handle does not come loose from the bag when set down. The present invention is designed for use transversely across the bag. None of this type were found in the U.S. patent files.

U.S. Pat. No. 5,516,175 by Arthur Christiansen is the only prior art found that has an annular ring to hold the bag handles. This embodiment has a single annular ring in the center of the handle. The fingers of the gripping hand straddle the mounted bag handles. Both bag handles must be fitted into the single ring. To avoid or minimize non-symmetrical loading of the hand, the bag handle must be placed between two fingers, which leaves the load divided between two stronger fingers and two weaker fingers. Furthermore the full load is always born near the middle joint of the fingers. Such an arrangement could fatigue the hand and wrist.

In the present invention, the grip may be placed at the proximal end of the fingers or even in the anterior portion of the palm, next the fingers. Both of these positions should be far less fatiguing than Christiansen's version.

U.S. Pat. No. 466,276, Dec. 29, 1891 by E. Le Garde. Titled "Dumb Bell" shows an exercise dumbbell with ting-aling bells on the ends of a handle. This reference is from non-analogous art. An inventor of ordinary skill in bag handling tools would not expect to find relevant prior art in either athletic equipment or musical instruments. The dumbbell shown in Le Garde FIG. 2 has many of the structural characteristics of the present invention, but probably would not successfully carry a modern plastic shopping bag because the axial shaft separating the inner and outer shells of the bell has too small of diameter and would put considerable stress on the bag handle.

Any proposal for enlarging the shaft would destroy the resounding qualities of the bell halves. Bells of this design ring most loudly and clearly when the central support is minimal, so as to not dampen the vibrations of the gong.

Furthermore, the outer edges are sharp and would likely cut the thin plastic handles of a modern plastic bag.

OBJECTS OF THE INVENTION

It is an object of the invention to provide a rigid gripping device as an intermediary between a carrier person's hand and the very flexible (hand binding) loop handles of a common thin disposable plastic grocery bag or the loops of a durable reusable fabric bag.

It is another object of the invention that the handle not tend to rotate axially.

It is another object of the invention that if the handle is rotated axially, it will not disengage from the loop handles of a grocery bag.

It is another object of the invention that if the grocery bag is set down, and the tension of the bag's loop handles on the auxiliary handle is released, the bag will not disengage from the auxiliary handle.

It is another object of the invention that the auxiliary handle be capable of carrying either a single grocery bag or at least two grocery bags.

It is another object of the invention, that during use, the bottom of a loaded grocery bag not be lowered significantly from the "normal" position to where it could drag on the ground when carried by a woman of average stature.

BRIEF SUMMARY OF THE INVENTION

The preferred embodiment of the presently disclosed shopping bag carrying handle is basically a rigid, round, gripping bar with annular slots at each end adapted to receive the loops of a common plastic grocery bag or the loops of a cloth carrying bag. In one embodiment, a bar of wood, plastic, metal, etc is turned to have a central portion adapted to be gripped by the hand of a person and support the load of one or more filled grocery bags. On each end, just outboard of the handle gripping portion are two knobs, each of which have an annular slot for receiving the loop handles of a shopping bag. The slot has a widened interior end, ie, a bulge, which allows the bunched up handle to expand and be retained within the slot with increased friction. When used to support a single bag, the handle is placed transversely across the bag, with one bag loop handle in each of the annular slots. When used to support two or more bags, both loop handles of each bag are placed in one of the annular slots.

Alternatively to turning, the invention may be cast in plastic or metal either in the turned shape or modified to have different handling characteristics.

TABLE OF IDENTIFIED DETAILS

1. The cylindrical embodiment of the invention
2. An embodiment with an offset handle.
3. The gripping zone or gripping bar portion of the handle
4. Inner knob portion of the bag holding means.
5. Outer knob portion of the bag holding means.
6. Annular slot for holding bag handle loops.
7. Central post, bottom of the slot.
8. Shopping bag.
9. Undulating grip enhancement means.
10. Slot entrance flaring.
11. Parallel sided portion of slot.
12. Bag holding bulge at bottom of slot.
13. Tapered sided slot forming a bulge at the bottom.
14. Pear shaped bulge.
15. Straight sided slot.

DETAILED DESCRIPTION OF THE INVENTION

Figure 1:
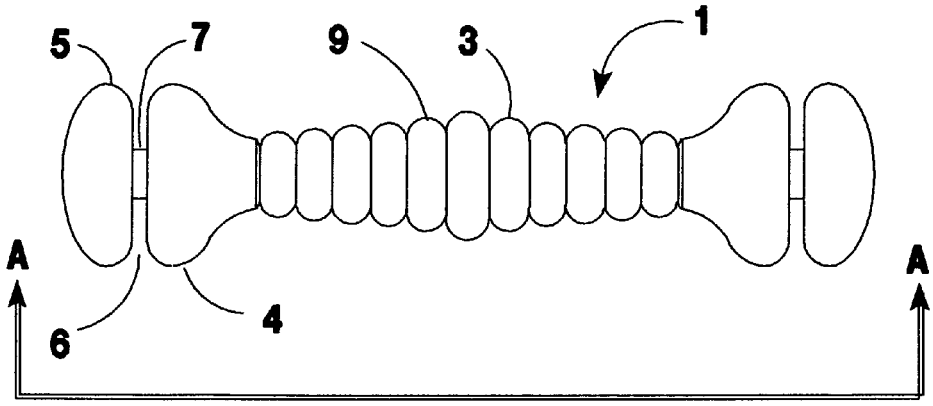
FIG. 1 is a side view of the preferred embodiment of the handle.
Figure 2:
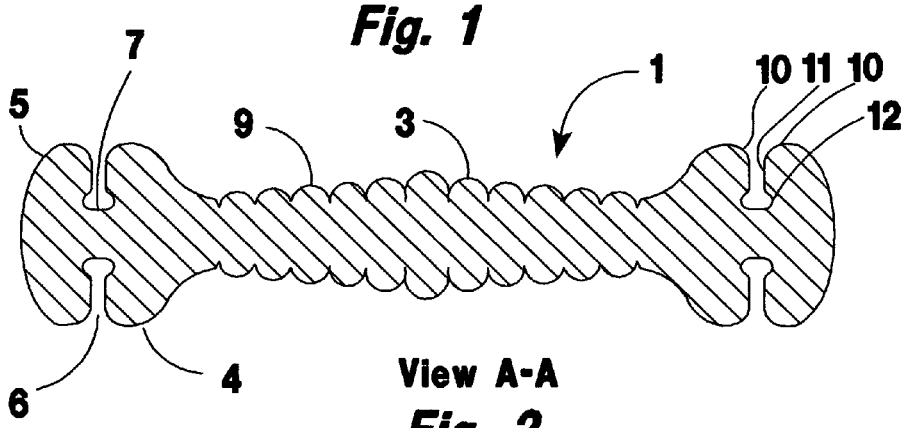
FIG. 2 is an axial cross section of FIG. 1.

Referring to FIG. 1, the handle 1 has a rigid central gripping portion 3 adapted to be held in a human hand. The preferred length of the gripping portion (grip bar) is approximately 4½ inches long and 1¼ inched in diameter at the center, which is adequate for most adult hands. A longer gripping portion permits the hand to be moved longitudinally along the gripping portion to balance unsymmetrical weight of two or more bags suspended from the ends of the handle. The gripping portion may or may not have surface patterning to improve grippability. FIG. 1 shows a grip enhancing pattern 9 as a series of rounded annular rings which are like the outer portions of torus arranged progressively larger from the ends to the middle forming a surface of undulating, rounded, hummocks. The preferred number of rings is 9, but fewer or more are acceptable and work well for the purpose.

The key feature of the present invention is the large knob on each end of the gripping bar 3. Each knob having an annular slot 6 dividing the knob into separated portions 4 and 5 and connected together by rod 7 at the bottom of the slot. Each slot is defined by two parallel or nearly parallel faces 11 extending from near the outer rims of the knob halves 4&5 inwardly at least ½ the slot depth. The interior end of the slots has an annular bulge 12 at the bottom. The external end of the slot is flared 10 either with a rounded or beveled transition from the slot sides to the knob periphery. In addition to providing a smooth transition (fairing) between the slot and the knob perimeter, flaring creates a funnel like shape to guide the bag handles into the slot and to break what otherwise would be a sharp edge which may cut the thin plastic of a common bag handle.

Figure 3:
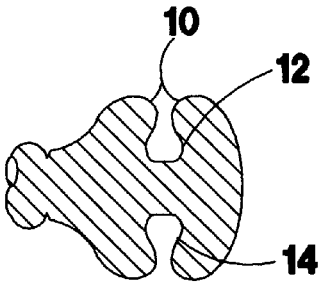
FIG. 3 is a cut away view showing a tapered side slot.
Figure 4:
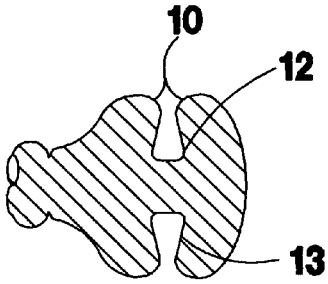
FIG. 4 is a cut away view showing a pear shaped slot.
Figure 8:
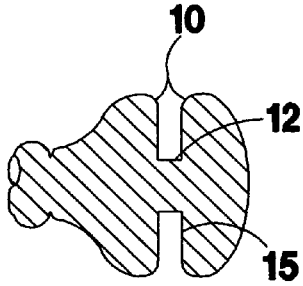
FIG. 8 is a cut away view showing a straight sided slot.

The bulge 12 at the bottom of the slot allows the bunched-up bag handle to expand thereby locking the handle into the slot which prevents the handle from falling off the bag when the bag is set down in the car for transport or while the user unlocks a car or house door or the like. Yet, the locking is not so secure that the handle is difficult to remove from the bag. One alternative way to produce the bulge is to have the slot walls taper away from each other, forming a wider bottom as illustrated in FIG. 3. Another alternative way to produce the bulge is to have the bulge extend from the interior of the flares to the bottom of the slot. Usually the slot/bulge side walls will open forming a pear shaped bulge. The bag handle will work equally well for carrying bags with the bulge omitted, but may not reliably retain the handles under relaxed conditions. It is obvious that without a bulge in at the bottom of the slot, the sides of the slot will be straight and essentially parallel from the entrance to the bottom, as illustrated in FIG. 8.

It has been found that the preferred width of the slot is ⅛ to 3⁄16 inch, and the bulge has a preferred width of approximately ⅜ inch or less, and a height of at least ⅜ inch.

At these dimensions, the loops fit easily within the slot and because of bunching in the bulge, are locked into the slot, and are retained when the tension is released. This retention is accomplished by friction alone, without mousing, clips, compression closures, or any other devices to prevent disengagement of the bag loop handles from the carrying handle.

Another feature of the present invention not found in the prior art, especially hook variants, is that when the load is lifted, the round handle may roll slightly which balances the tension on the bag handle bands depending from each side of the slot and rod 7. This reduces the likelihood of one band being over stressed and breaking.

The central bag hanging rods 7 are generally cylindrical having a minimum diameter of approximately ½ inch. This is sufficient to provide adequate strength to join the two knob segments, to resist the various forces encountered from heavy suspended loads, and to spread the load on the bag handles so they do not break.

The overall length of the preferred embodiment is approximately 7¼ inches. The knobs are 1½ inches in diameter, and each half has an axial length of approximately ⅜ inch. The outer perimeter of the knobs is gently rounded so as to not have any corners or edges. This prevents the handle from scuffing a car seat while in use, or the insides of a purse or pocket while being transported to the grocery store. At the knob ends, while shown in the figures as being rounded, the rounding is modest, having a radius not of at least 1¼ inches to leave an adequately flat surface to be embossed or printed with a logo, advertising, or other indicia. The axial thickness of the knobs provides strength against cantilever forces applied to the outer half of the knobs when the loaded handle is tipped, causing the bag to hang at an acute angle to the handle axis and bear against the outer knob portion.

Many people like the feel, warmth, appearance, and uniqueness of wood grain. The cylindrical embodiment may be manually turned on a lathe, which, when hand turned, may have the added appeal that each article is shaped slightly uniquely differently. The shape, large radiuses, and cross sectional thickness of the bar, rods, and knobs is ideal for turning in wood.

However, the preferred embodiment may be mass produced by molding in plastic. An optional central bore may be included to reduce the amount of material used.

HOW TO USE THE INVENTION

Figure 6:
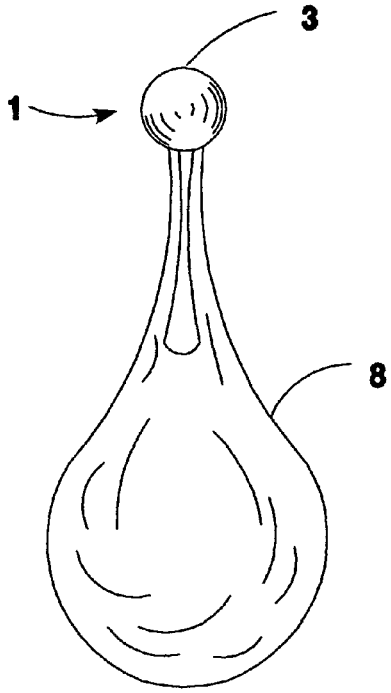
FIG. 6 is an end view of the handle with a bag attached.
Figure 5:
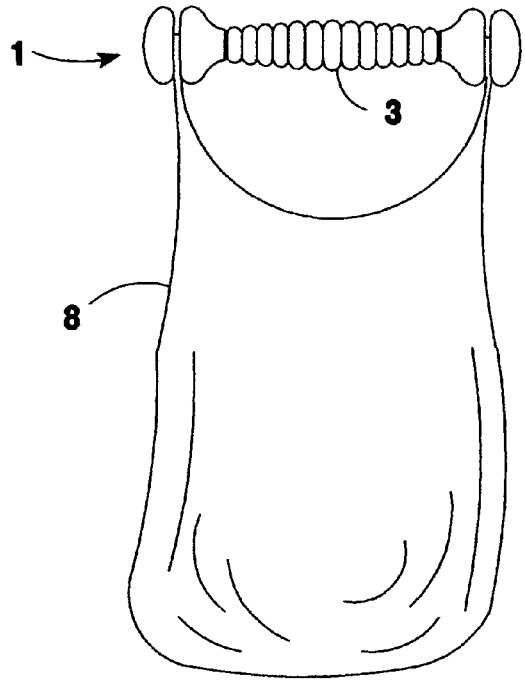
FIG. 5 is a side view of the handle with a bag attached.
Figure 7:
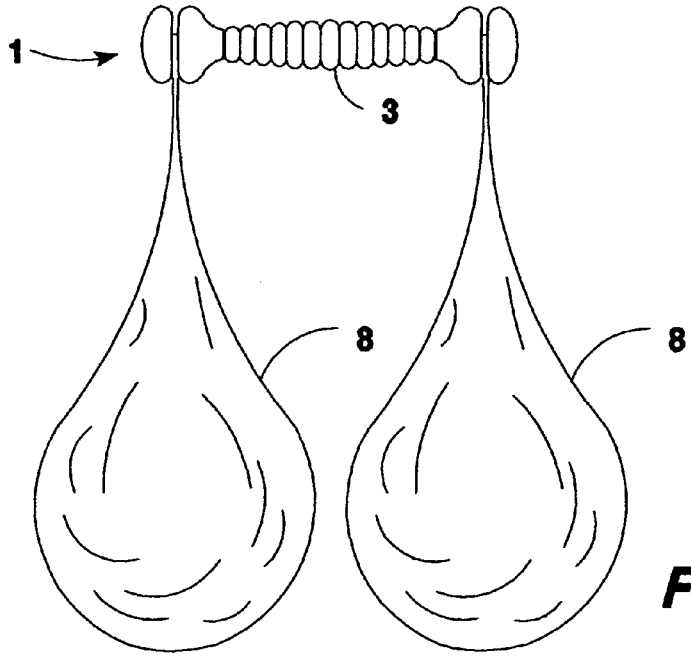
FIG. 7 is a side view of the handle holding two bags.

FIGS. 5, 6, and 7 illustrate the handle holding a grocery bag.

FIGS. 5 and 6 show the bag hanging from the rod 7 within the slots 6, and the handle oriented across the bag.

FIG. 7 illustrates the handle supporting two bags, one from each end.

The loop handles of a loaded grocery bag are passed into the annular slot as previously described, and the assembly of bag and handle grasped in the hand and lifted, to be carried away. However, to improve the ability to prevent disengagement and also to provide slightly more bearing circumference, the loop handles may be twisted 180 degrees before being inserted into the slots. To release the handle, the loops are simply lifted out of the annular slots.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention as defined by the claims which follow.

The embodiments of the invention in which an exclusive property right or privilege is claimed are defined as follows:

I claim:

1. A handle for lifting and carrying a grocery bag comprising:

a. a rigid elongated bar adapted for being gripped by a human hand, and b. first and second knobs each attached to an end of said bar, and each knob being radially larger than said bar, and each knob having first and second portions attached together with a gap therebetween by an axial rod proximate the centers of the knob portions and extending from the first knob portion to the second knob portion, said rod having a diameter less than said bar, and each knob portion axially attached to an end of said rod, c. whereby, said rod separates said first and second portions of the knob thus forming an annular slot for receiving therein at least one loop handle of a bag, and d. the outer edges of the annular slots are flared to form a tapered entrance into the slot, and e. the gripping bar has a friction enhancing surface comprising a series of annular rings forming surface of adjacent undulating, rounded, hummocks, and f. whereby, said knobs, in cooperation with said gripping bar, comprise a handle adapted for lifting and carrying a shopping bag by a human hand.

2. The handle of claim 1 where the gripping bar, knobs, annular slots, axial attaching rods are symmetrical about a common axis.

3. The handle of claim 1 where the annular slots are adapted to retain said loop handles of a bag within said slot by friction.

4. The handle of claim 1 where the annular slots between the knob portions have essentially parallel sides extending from the outer periphery to said connecting rod.

5. The handle of claim 1 where said annular slots have an enlarged width at the interior terminus, whereby the wider slot portion receives and entraps the handle portion of a carrying bag.

6. The handle of claim 5 where said wider slot portion has a pear shape.

7. The handle of claim 1 where the sides of the annular slots between the knob portions taper away from each other, whereby the inner end of the slots is wider than the outer end.

8. The handle of claim 1 where the narrowest width of the annular slots between the knob portions is ⅛ to 3⁄16 inch.

9. The handle of claim 1 where the outer ends of said second knob portion have a radius of at least 1¼ inches, thereby having an end surface adapted to receiving indicia applied thereon.

10. The handle of claim 1 where the axial length of each first and second knob portions is approximately ⅜ inch.

11. A handle for lifting and carrying a bag comprising:

a. first and second knobs attached to the ends of an elongated round bar, said bar being adapted to be gripped by a human hand, and b. each knob further comprising inner and outer portions, said inner portion being attached to said elongated bar, and said outer portion connected by an axial rod extending between said inner and outer portions, thereby creating an annular slot for receiving the loop handle of a bag, and c. wherein each knob is radially larger than said gripping bar, and c. wherein said slot is wider at the interior end than at the outer end, and d. wherein the slot is flared at the outer end, and e. wherein each slot is adapted to receive the loop handle of a shopping bag.

12. A handle for lifting and carrying a grocery bag comprising:

a. a round, elongated bar adapted to be received by a human hand, where said bar has an a longitudinal axis of symmetry, and b. first and second knobs are attached to said bar in axial alignment with said longitudinal axis, and c. each of first and second knobs being a larger diameter than said bar and each knob having an annular slot therein dividing each knob into two parts connected by an axially located cylindrical rod, and d. wherein the bar has a surface patterning to increase the ability to grip said bar, and e. wherein said slot is wider at the interior end than at the outer end, and f. wherein the slot is flared at the outer end, and g. wherein each slot is adapted to receive and enclose at least one handle of a bag for lifting and carrying said bag.

* * * * *